US006722845B2

(12) United States Patent
Chard et al.

(10) Patent No.: US 6,722,845 B2
(45) Date of Patent: Apr. 20, 2004

(54) VANE ACTUATOR

(75) Inventors: David Chard, Wolverhampton (GB); Stephen John Cutts, Wolverhampton (GB); Luis Alberto Arce, Wolverhampton (GB); Timothy Hudson, Telford (GB)

(73) Assignee: Lucas Industries Limited (GB)

( * ) Notice: Subject to any disclaimer, the term of this patent is extended or adjusted under 35 U.S.C. 154(b) by 0 days.

(21) Appl. No.: 10/191,376

(22) Filed: Jul. 8, 2002

(65) Prior Publication Data

US 2003/0007865 A1 Jan. 9, 2003

(30) Foreign Application Priority Data

Jul. 7, 2001 (GB) ..... 0116675

(51) Int. Cl.[7] ..... F01D 17/16
(52) U.S. Cl. ..... 415/150; 415/160
(58) Field of Search ..... 415/157, 159, 415/160, 150

(56) References Cited

U.S. PATENT DOCUMENTS 3,029,067 A * 4/1962 Parker et al. ..... 415/9
4,585,390 A * 4/1986 Pirtle et al. ..... 415/160
5,061,152 A * 10/1991 Marey ..... 415/150

* cited by examiner

*Primary Examiner*—Ninh H. Nguyen
(74) *Attorney, Agent, or Firm*—Andrus, Sceales, Starke & Sawall

(57) ABSTRACT

A vane actuator for use in a turbine engine, comprising a carrier member carrying a plurality of vanes which is angularly movable, in use, so as to vary the position of the vanes relative to an airflow through the engine. The actuator includes an electrical drive arrangement comprising an input shaft which is arranged to drive an output shaft coupled to the carrier member. The electrical drive arrangement includes a brake arrangement arranged to apply a braking load to the input shaft in the event that an interruption occurs in the electrical drive arrangement.

14 Claims, 6 Drawing Sheets

VANE ACTUATOR

CROSS-REFERENCE TO RELATED APPLICATION

This application claims priority to Great Britain application No. 0116675.0, filed Jul. 7, 2001.

The invention relates to a vane actuator for use in controlling movement of a plurality of guide or stator vanes in a gas turbine engine.

An axial flow, multi stage compressor for a gas turbine engine typically includes alternate rows of rotating (rotor) blades and stationary (stator) or guide vanes to accelerate and diffuse the flow of air to the turbine. As each stage of a multi stage compressor has air flow characteristics that are different from those of the preceding and subsequent stages, it is necessary to ensure the characteristics of each stage are carefully matched. In order to achieve reasonable matching over a range of operating conditions, the vanes are actuable to direct the air flow onto the subsequent rotor vanes at an acceptable angle.

A typical drive mechanism for the variable guide or stator vanes of a multi stage compressor is shown in FIG. 1. The vanes (not shown) are coupled to a retaining or carrier ring 10 (also known as a unison ring) which is driven, through a suitable linkage, by means of an actuator arrangement comprising a first, master actuator 12 and a second, slave actuator 14.

Each of the first and second actuators 12, 14 includes an electrohydraulic servo valve which is arranged to control the flow of pressurised fluid to respective first and second chambers of a linear actuator piston coupled to the carrier ring 10. The servo valve is supplied with an electrical current which energises a winding of the servo valve to control the position of a spool valve and, hence, the flow of fluid to the first and second chambers. By controlling the position of the servo valve, the pressure of fluid within the first and second chambers can be varied so as to drive the carrier ring 10, and hence the guide vanes, into the required position. For most of their service life, the hydraulic actuation system serves to retain the variable vanes in a fixed position appropriate for engine cruising speed. During take off and landing, the hydraulic actuation system is operated to adjust the position of the guide vanes to compensate for variations in airflow through the compressor.

One problem associated with such hydraulic actuation systems is that, in the event of loss of control of the system or pressure within the first and second control chambers, the guide vanes become free to move in the compressor airflow. In order to avoid the possibility of engine overspeed in the event of such a failure, the engine will be shut down.

It is an object of the present invention to provide an actuator suitable for use in moving variable vanes of a gas turbine engine which removes or alleviates the aforementioned problem.

According to the present invention, there is provided a vane actuator for use in a turbine engine, comprising a carrier member carrying a plurality of vanes which is angularly movable, in use, so as to vary the position of the vanes relative to an airflow through the engine, an electrical drive arrangement comprising an input shaft which is arranged to drive an output shaft coupled to the carrier member, the electrical drive arrangement comprising a brake arrangement arranged to apply a braking load to the input shaft in the event that an interruption occurs in the electrical drive arrangement.

The invention provides the advantage that, in the event of the occurrence of a fault in the electrical drive arrangement, for example due to an electrical supply failure, a power-off brake applies a braking force to the input shaft.

The application of the braking force to the input shaft serves to lock the carrier member, and hence the vanes, in a fixed position relative to the airflow. Undesirable movement of the vanes is therefore substantially avoided. Thus, in the event of an electrical supply failure, there is no risk of surge or need to take the precaution of immediately shutting down the engine in anticipation of engine overspeed.

A further advantage of the present invention is that the use of electrically driven actuation systems on aircraft offers the potential for increased aircraft reliability and efficiency and reduced weight, maintenance and manufacturing cost.

Preferably, the output shaft has an input, drive end which is coupled to the input shaft through a gear arrangement and an output, driven end which is coupled to the carrier member. The carrier member preferably takes the form of a carrier ring.

In a preferred embodiment, the electrical drive arrangement comprises a motor, the input shaft being rotatable under the influence of the motor.

The brake arrangement preferably comprises a plurality of first brake elements which are rotatable with the input shaft and which are engageable with respective ones of a plurality of second brake elements to control the braking load applied to the input shaft.

Preferably, the brake arrangement further comprises an electromagnetic actuator comprising an armature which is carried by the input shaft and which is movable under the influence of a magnetic field generated by an energisable winding.

The electromagnetic actuator may be arranged such that energisation of the winding causes the armature to be attracted towards the winding, thereby causing the first and second brake elements to disengage from one another to remove the braking load from the input shaft, de-energisation of the winding causing the first and second brake elements to move into engagement with one another under the action of a return spring such that the braking load is applied to the input shaft.

The vane actuator may include a ballscrew actuator comprising an input member which is angularly movable upon rotation of the input shaft, the output shaft being axially movable upon angular movement of the input member. The output shaft may be coupled to a linkage, the linkage being arranged to impart angular movement to the carrier ring upon axial movement of the output shaft.

The input member may be provided with a screw thread formation including a helical groove, spherical elements being carried by the output shaft and being in rolling engagement in said helical groove to form a ballscrew coupling between the input member and the output shaft.

The input member of tie ballscrew actuator may be provided with a flange to which the input shaft is coupled through a gear arrangement. Preferably, the ballscrew actuator comprises overload protection means for applying a braking force to the input member in the event that an axial overload is applied to the output shaft, thereby to prevent loading of the electrical drive arrangement.

For example, the actuator may be provided with first and second abutment surfaces, a region of the input member, for example a flange, being engageable with one or the other of the first or second abutment surfaces in the event that the overload is applied to the output shaft, frictional engagement between the region of the input member and the first or second abutment surface causing the braking load to be applied to the input member to arrest rotation thereof.

As rotation of the input member is prevented upon engagement between the flange and the first or second abutment surface, any loading of the electrical drive or gear arrangement, which may otherwise cause substantial position change of the vanes, is limited to an acceptable level.

In an alternative embodiment, the actuator may include a rotary actuator.

In a preferred embodiment, the actuator includes first and second ballscrew actuators having respective output shafts, each of the output shafts being coupled to the carrier member and being coupled together through a common drive and synchronisation shaft to ensure axial movement of the output shafts is substantially synchronised.

The occurrence of a fault condition in the electrical drive arrangement may originate either within the electrical drive arrangement itself or may be generated externally to the electrical drive arrangement, and typically may arise as a result of either a total or partial electrical supply failure.

Electrical supply may be intentionally interrupted during fixed engine operating conditions.

The invention will now be described, by way of example only, with reference to the accompanying drawings in which.

Figure 1:
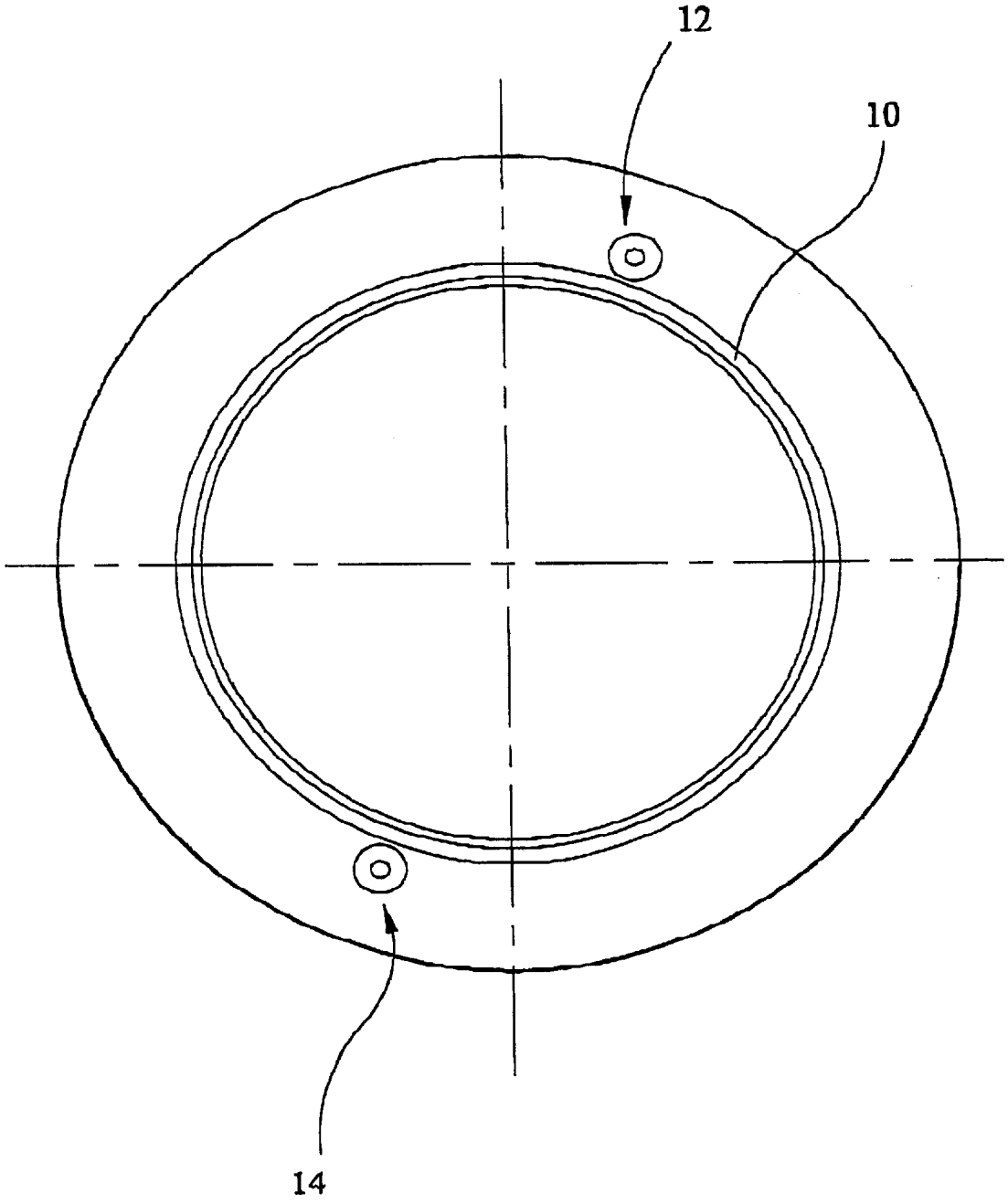
FIG 1 Prior art
FIG. 1 is a plan view of a carrier ring forming part of an conventional vane actuator.
Figure 2:
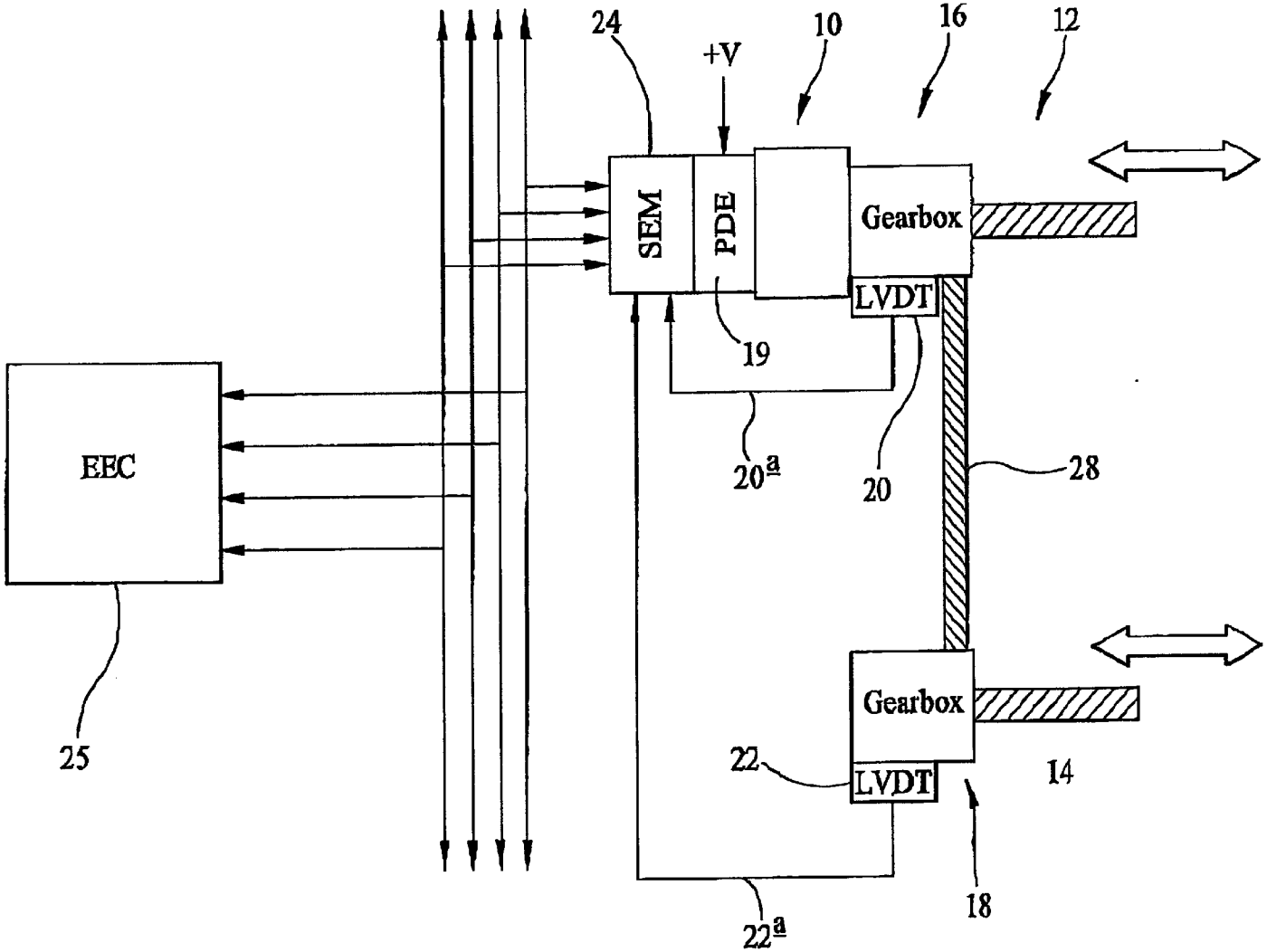
FIG. 2 is a schematic diagram of a control system including the vane actuator of the present invention.

Referring to FIG. 2, there is shown a control system including a vane actuator comprising an electrical drive arrangement, referred to generally as 10, for driving first and second ballscrew actuators 12, 14 respectively. The first and second ballscrew actuators 12, 14 are driven by means of the electrical drive arrangement 10 through first and second gear arrangements 16, 18 respectively. Each of the first and second ballscrew actuators 12, 14 is coupled to a retaining or carrier ring (not shown) through an appropriate linkage, the carrier ring carrying a plurality of stator or guide vanes of a multi stage compressor. Typically, the first ballscrew actuator 12 is coupled to the carrier ring at a point diametrically opposite the point at which the second ballscrew actuator 14 is coupled to the carrier ring.

The first and second gear arrangements 16, 18 are each provided with a position sensor 20, 22, typically in the form of an RVDT (Rotary Variable Differential Transducer) or an LVDT (Linear Variable Differential Transducer). The RVDTs 20, 22 generate position signals 20*a*, 22*a* respectively which are indicative of the position of the gear arrangements 16, 18 and, hence, of the first and second ballscrew actuators 12, 14. The position signals 20*a*, 22*a* are fed back to an electronic controller 24 which is arranged to supply control signals to the electrical drive arrangement 10 in response to a position demand signal from the Electronic Engine Controller (EEC) 25 and the position feedback signals 20*a*, 22*a* so as to move the ballscrew actuators 12, 14 into the demanded position. The first and second gear arrangements 16, 18 are coupled together through a common synchronisation shaft 28 to ensure movement of the ballscrew actuators 12, 14 is substantially synchronised.

Figure 3:
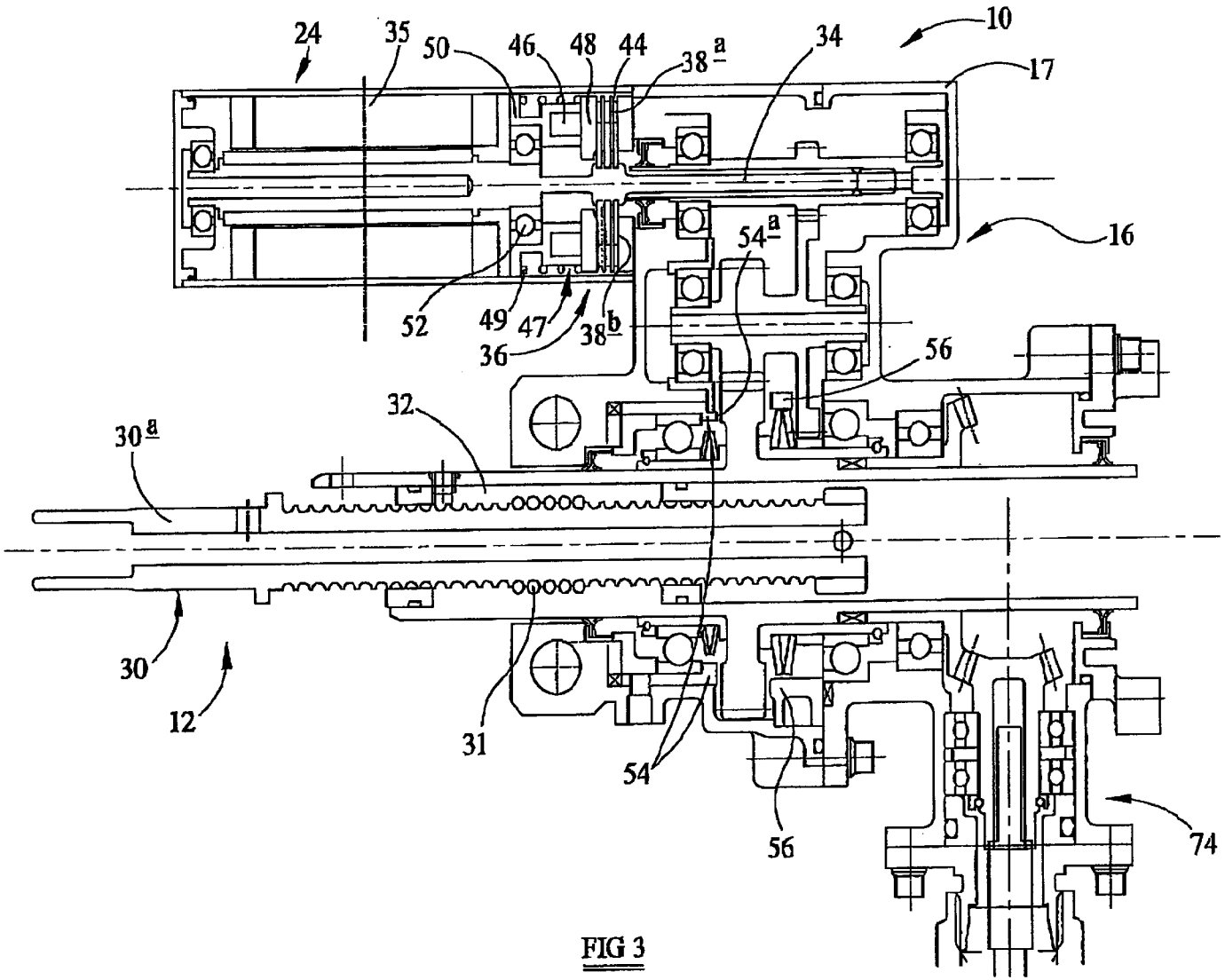
FIGS. 3, 4 and 5 are sectional views of respective parts of a vane actuator in accordance with a first embodiment of the invention.
Figure 5:
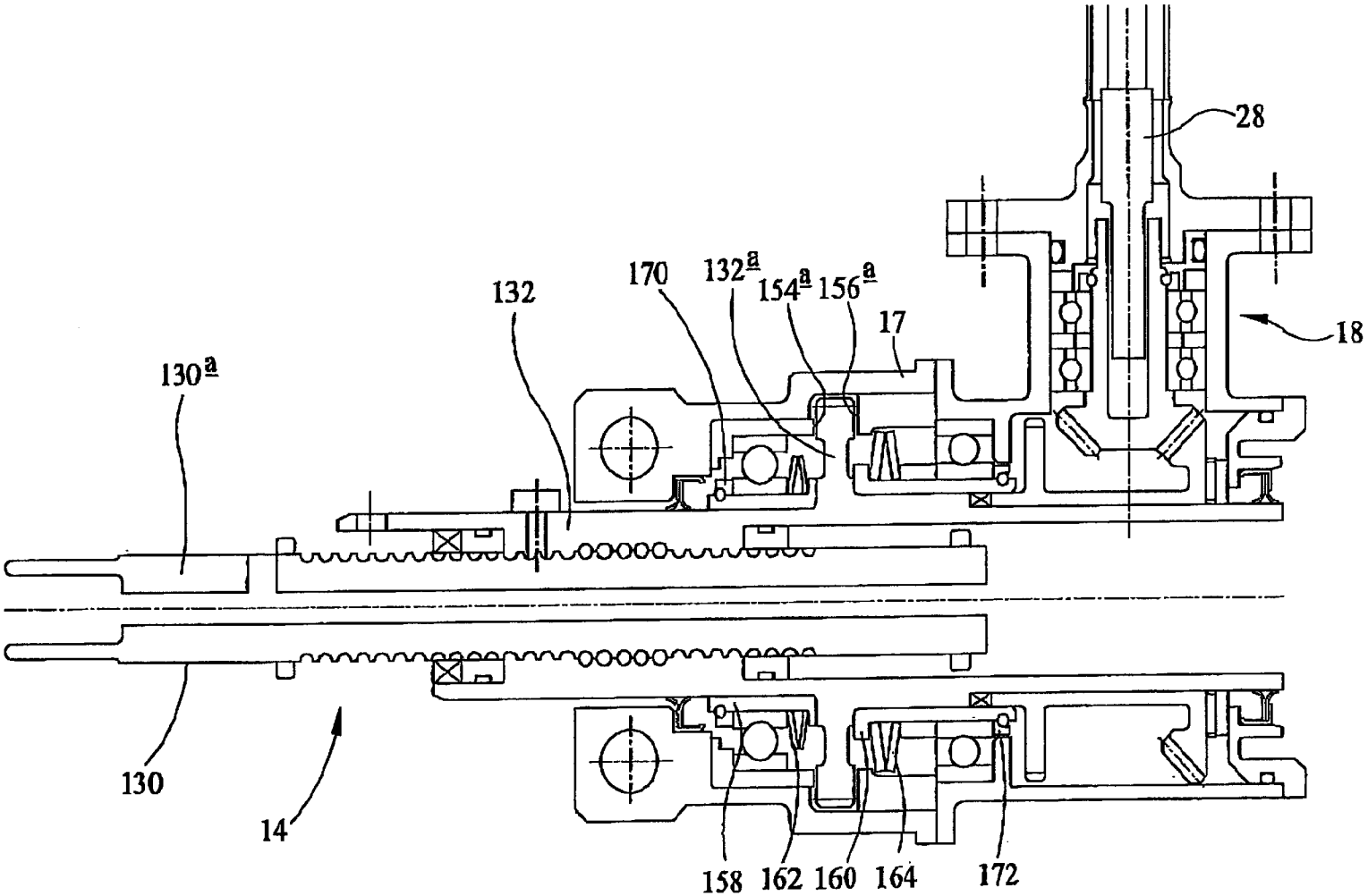

FIGS. 3 and 5 show sectional views of the first and second ballscrew actuators 12, 14 respectively, Referring to FIG. 3, the first ballscrew actuator 12 includes an axially moveable output shaft 30, a driven end 30*a* of which extends through an actuator housing 17 and is adapted to be coupled to the carrier ring. Conveniently, the output shaft 30 is coupled to the carrier ring through a separate linkage and is arranged to impart angular movement to the carrier ring upon axial movement of the output shaft 30. The ballscrew actuator 12 also includes an input member 32 provided with a screw thread formation including a helical groove, the input member 32 being coupled to the input shaft 34 such that rotary movement of the input shaft 34 is transmitted to the input member 32. A plurality of balls 31 are carried by the output member 30, the balls being in rolling engagement in the helical groove so as to form a ballscrew coupling between the input member 32 and the output shaft 30 through which rotary movement of the input member 32 imparts axial movement to the output shaft 30.

The input drive shaft 34 is rotatable, in use, under the influence of a motor 35 forming part of the electrical drive arrangement 10. A support member 50 is secured to or integrally formed with the housing 17, the support member 50 carrying a bearing 52 which serves to guide the input shaft 34 for rotary movement within the actuator housing 17. The input shaft 34 is coupled to a flange 32*a* provided on the input member 32 through the first gear arrangement 16 such that, as the input shaft 34 rotates under the influence of the motor 35, the input member 32 is caused to rotate to impart axial movement to the output shaft 30.

The input shaft 34 is provided with a brake arrangement, referred to generally as 36, comprising a stack of first and second brake elements 38*a*, 38*b* respectively in the form of brake discs. Alternate ones of the brake discs 38*a* (the first set of brake discs) are keyed to the input shaft 34 such that they are rotatable with the input shaft 34 and are free to move axially, relative to the shaft, by a predetermined, limited amount. The remaining brake discs 38*b* (the second set of brake discs) are keyed to a part 44 of the actuator housing 17 and are able to move axially relative to the housing part 44. An end surface of the housing part 44 acts as an abutment surface for the first set of brake discs 38*a*.

The electrical drive arrangement 10 also includes an electromagnetic actuator 47 comprising an energisable winding or coil 46 operable to control movement of an armature 48. A return spring 49 is arranged to apply a biasing force to the armature 48 which serves to urge the armature into engagement with an end one of the first brake discs 38*a*, thereby urging the first brake discs into engagement with the second brake discs 38*b* to apply a braking load to the input shaft 34 so as to prevent rotation thereof. The electromagnetic actuator 47 is arranged such that energisation of the winding 46 causes the armature 48 to be attracted towards the winding 46, against the force due to the spring 49, thereby causing the compressive load applied to the first brake discs 38*a* to be removed. The first and second brake discs 38*a*, 38*b* are therefore disengaged and the braking load is removed from the input shaft 34. When the winding 46 is de-energised, the armature 48 is urged into engagement with an end one of the first brake discs under the force of the spring 49.

In the illustration shown in FIG. 3, the flange 32*a* provided on the input member 32 is spaced away from first and second abutment surfaces 54*a*, 56*a* of first and second abutment members 54, 56 respectively forming part of or non-rotatably mounted upon the actuator housing 17. First and second spring biased sleeves 58, 60 respectively are carried by the input member 32 and appropriate bearings 66, 68 are provided to guide the sleeves 58, 60 and the input member 32 for rotary movement within the actuator housing 17. First and second springs 62, 64 are arranged to act on the first and second sleeves 58, 60 respectively, the spring forces being selected to ensure that, in normal use, the flange 32*a* is maintained in a substantially central position in which it is spaced away from tee first and second abutment surfaces 54*a*, 56*a*, the movement of the sleeves 58, 60 being limited by first and second stops 70, 72 respectively. The first and second sleeves 58, 60 are free to move axially with the input member 32, against the action of the first and second springs 62, 64 respectively, in the event that an external, axial overload is applied to the output shaft 30, as will be described in further detail hereinafter.

As well as being coupled to the input shaft 34 through the first gear arrangement 16, the input member 32 is also coupled to the synchronisation shaft 28 through a further gear arrangement 74. As can be seen in FIG. 5, the transmission shaft 28 is also coupled to a second ballscrew actuator 14 through the second gear arrangement 18, the second ballscrew actuator 14 comprising a second input member 132 arranged to impart axial movement to a second output shaft 130. An end, driven region 130*a* of the second output shaft 130 is adapted to be coupled to a linkage carried by the carrier ring, as described previously. The provision of the synchronisation shaft 28 ensures drive imparted to the first actuator 12 is transmitted and substantially synchronised with that imparted to the second actuator 14 to prevent undesirable stresses being induced in the carrier ring. The second ballscrew actuator 14 is provided with a substantially identical arrangement of spring biased sleeves and abutment surfaces to that shown in FIG. 3, comprising first and second sleeves 158, 160, first and second springs 162, 164 and first and second abutment surfaces 154*a*, 156*a* for the flange 132*a*. Respective first and second stops 170, 172 are also provided to limit movement of the first and second sleeves 158, 160, as described previously.

In use, when it is required to vary the position of the vanes, the winding 46 of the electrical drive arrangement 10 is energised, thereby causing the armature 48 to be attracted towards the winding 46, against the force of the return spring 49, to remove the compressive load applied to the brake discs 38*a*, 38*b*. The input shaft 34 is therefore free to rotate under the influence of the motor 35. Rotary movement of the input shaft 34 is transmitted through the first gear arrangement 16 to the input member 32 of the first actuator 12, thereby imparting axial movement to the output shaft 30. Additionally, rotary movement of the input shaft 34 is transmitted through the transmission shaft 28 and the gear arrangement 18 to the input member 132 forming part of the second actuator 14. The output shaft 130 of the second actuator 14 is therefore also moved axially by a substantially equivalent amount.

When the position sensors 20, 22 provide position feedback signals 20*a*, 22*a* to the electronic controller 24 to indicate that the first and second actuators 12, 14, and hence the carrier ring and engine guide vanes, have been moved into the required position, the winding 46 may be de-energised. The armature 48 is therefore urged towards the right in the illustration shown under the force of the spring 49, thereby causing a compressive load to be applied to the first and second brake discs 38*a*, 38*b*. A braking load is therefore applied to the input shaft 34, braking of the input shaft 34 preventing further axial movement of the output shafts 30, 130 such that the carrier ring is held in the required position.

In the event that an electrical supply failure occurs, or any fault occurs internally or externally to the electrical drive arrangement 10 such that the winding 46 is caused to de-energise, the armature 48 will be urged away from the winding 46 under the force of the return spring 49 to cause the first and second brake discs 38*a*, 38*b* to be urged into engagement with one another. Thus, should such a fault or failure occur whilst the vanes are being moved into their demanded position, a braking force will be applied to the input shaft 34 to maintain the vanes in a fixed position. In existing systems, if there is a risk of uncommanded movement of the vanes due to movement with the airflow, surge may occur and it is necessary to halt operation of the engine to avoid the possibility of engine overspeed. The present invention removes the need to halt engine operation in the event of such a failure.

Another advantage provided by the present invention is that there is no need to supply continuous power during constant speed operation of the engine (cruise) as the vanes are held in position upon de-energisation of the winding 46. When using hydraulic actuation systems, there is a need to continuously supply high pressure fuel to the actuation system and this requires the supply of continuous power. The use of the electrical drive arrangement 10 also removes the need for hydraulic flow lines to the vanes such that the risk of high pressure fuel leakage is reduced. The weight of the actuator can also be reduced due to the elimination of the hydraulic pipes. Further, during maintenance operations, the need to drain and subsequently prime the hydraulic circuit for the actuators is removed, reducing time for maintenance operations.

In the event that an excessive, external axial load is applied to either the first or second output shafts 30, 130, for example due to engine surge forcing the vanes and the carrier ring to move, an undesirable angular load will be applied through the input members 32, 132 to the first and second gear arrangements 16, 18 and, hence, to the electrical drive arrangement 10 causing a positional change in the actuating system. If an external axial load is applied to the output shaft 30 to urge the shaft 30 towards the right in the illustration shown in FIGS. 3 and 4, a reverse, angular load imparted to the input member 32 causes the flange 32*a* to be urged into engagement with the second abutment surface 56*a* against the force due to the second spring 64. Frictional engagement between the flange 32*a* and the second abutment member 56 serves to resist rotation of the input member 32 such that only a limited load will be transmitted to the first gear arrangement 16 and, hence, to the electrical drive arrangement 10. This frictional force will prevent movement of the vanes away from the set position.

Figure 4:
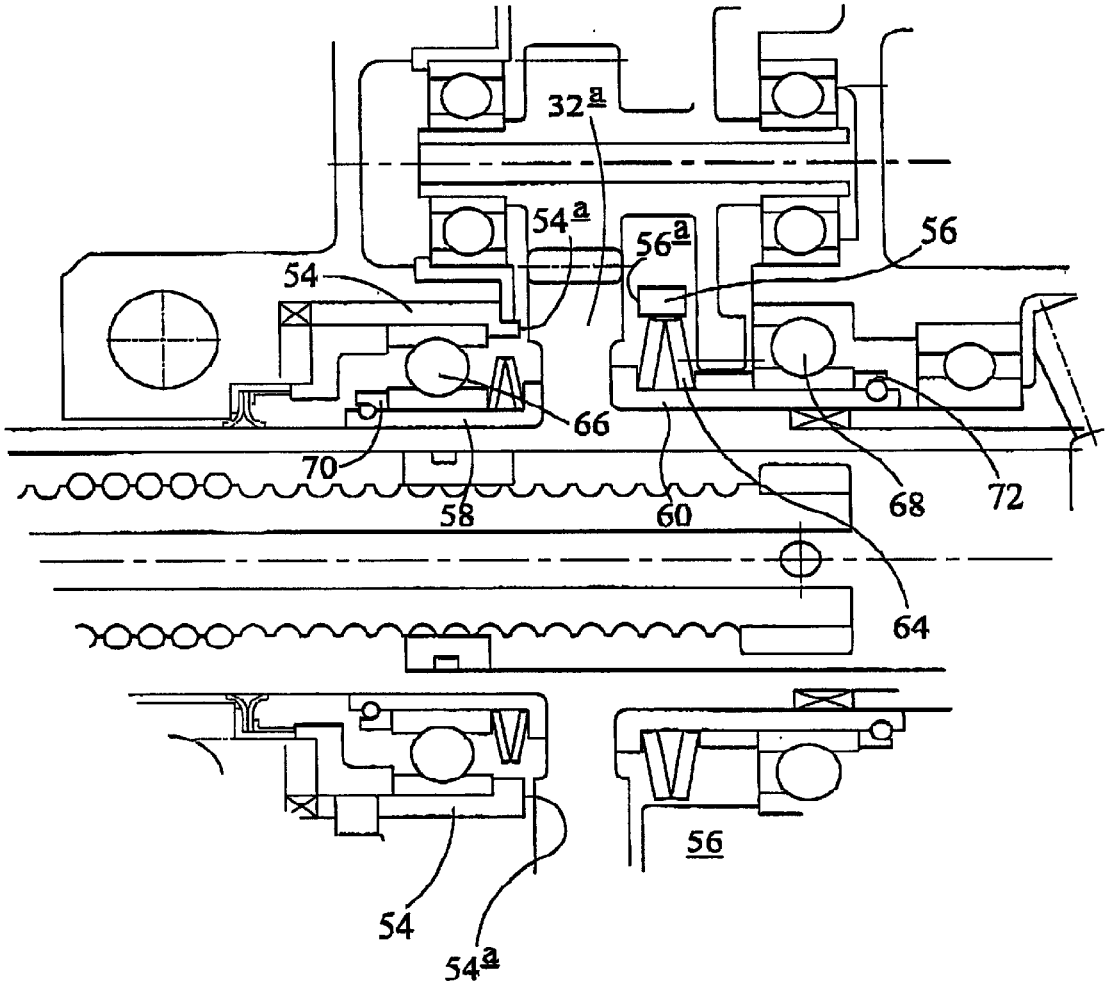

If an external axial load is applied to the output shaft 30 to urge the output shaft 30 to the left in the illustration shown in FIGS. 3 and 4, the load imparted to the input member 32 serves to urge the first sleeve 58 to the left, against the force due to the first spring 62, thereby causing the flange 32*a* to engage the first abutment surface 54*a*. As described previously, frictional engagement between the flange 32*a* and the first abutment surface 54*a* serves to resist rotation of the input member 32 and, hence, reduces the load imparted to the first gear arrangement 16 and, hence, the electrical drive arrangement 10. The provision of the first and second sleeves 58, 60 and the first and second abutment surfaces 54*a*, 56*a* therefore provides a bi-directional overload protection arrangement which serves to limit any movement of the first and second gear arrangements 16, 18 and the electrical drive arrangement 10 in the event that an undesirable axial overload is applied through the output shaft 30 to the input member 32.

Typically, the axial load applied to the output shaft 30 through the vanes may arise due to surge within the compressor. Once the condition has passed, the axial load is removed from the shaft 30 and the flange 32*a* will be urged towards its central position (as shown in FIG. 3) under the influence of either the first or second spring 62, 64.

It will be appreciated that the first and second springs 62, 64 may be selected to provide different braking characteristics for oppositely directed external loads applied to the output shaft 30. It will further be appreciated that the forces provided by the first and second springs 62, 64 must be selected to ensure that, during normal operation, when rotary movement of the input shaft 34 is transmitted to the input member 32 to cause axial movement of the output shaft 30, any slight loading against the springs 62, 64 is not sufficient to cause the flange 32*a* of the input member 32 to engage either the first or second abutment surfaces 54*a*, 56*a*.

In an alternative embodiment to that shown in FIG. 5, the input member 132 of the second actuator 14 may be geared to the input shaft 34 through the flange 132*a*, rather than through the synchronisation shaft 28. The provision of the synchronisation shaft 28 does, however, provide the advantage that axial movement of the first and second output shafts 30, 130 is substantially synchronised.

Figure 6:
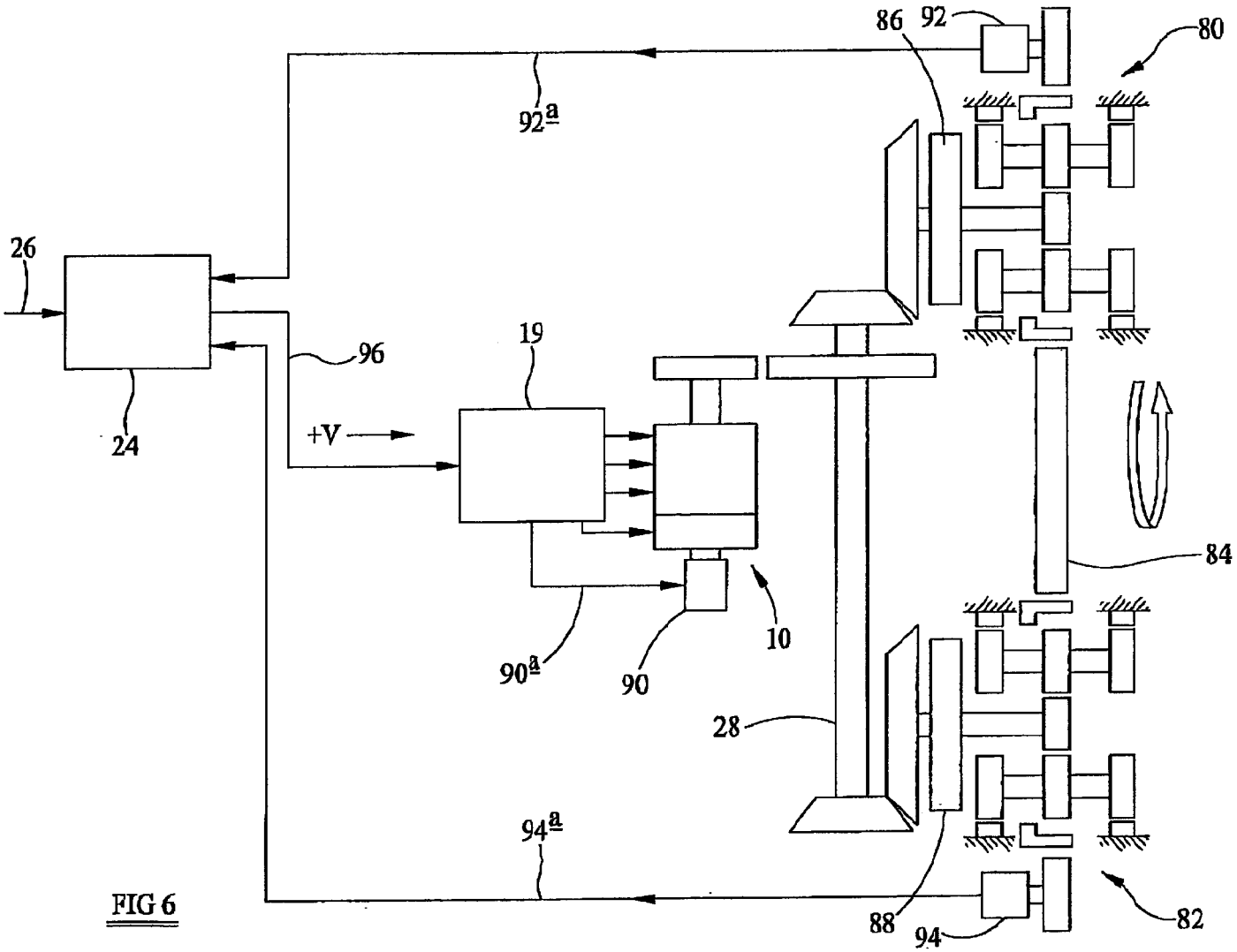
FIG. 6 is a schematic diagram of a control system including an alternative embodiment of the vane actuator to that shown in FIGS. 3, 4 and 5.

The actuators 12, 14 need not take the form of ballscrew actuators, as shown in FIGS. 3 and 5, but may alternatively take the form of rotary actuators 80, 82 as shown in FIG. 6. The rotary actuators 80, 82 are driven through a common synchronisation shaft 28, as described previously, and are arranged to impart angular movement to a carrier ring 84 carrying the guide vanes. Each of the rotary actuators 80, 82 is provided with a torque limiting device 86, 88 in a conventional manner. The electrical drive arrangement 10 is provided with a sensor 90 which provides a feedback signal 90*a* to motor drive electronics 19. Position sensors 92, 94, typically in the form of RVDTs, are provided on the first and second rotary actuators 80, 82 respectively and provide position feedback signals 92*a*, 94*a* respectively to the electronic controller 24. In response to the position feedback signals 92*a*, 94*a* and the position demand signal 26, the electronic controller 24 supplies a speed demand signal 96 to the motor drive electronics 19 to cause rotation of the input shaft at the speed required to move the vanes into the demanded position.

Although the electrical drive arrangement 10 described hereinbefore includes a brake arrangement comprising an electromagnetic actuator of the energise-to-attract type, it will be appreciated that an electromagnetic actuator of the energise-to-repel type may be employed. A power-off brake of the energise-to-attract type is described in our co-pending European patent application No. 1061282 A, the contents of which are incorporated herein by reference. As described in our co-pending European patent application, the brake elements 38*a*, 38*b* of the electrical drive arrangement 10 may, but need not, be provided with a surface coating to increase the coefficient friction of the brake elements to a value greater than 0.2.

Although not essential the first and second abutment surfaces, 54*a*, 154*a* and 56*a*, 156*a* respectively, may also be provided with a frictional coating to improve the braking load applied to the input members 32, 132, in the event that the axial overload is imparted to the output shafts 30, 130.

It will be appreciated that, although the vane actuator hereinbefore described comprises two actuators for the carrier ring, embodiments of the invention are also envisaged in which only one actuator is employed or in which more than two actuators are employed. In the latter case, a common electrical drive arrangement may be arranged to drive all of the actuators, or separate electrical drive arrangements, each provided with an appropriate power-off brake, may be arranged to drive respective ones of the actuators.

We claim:

1. A vane actuator for use in a turbine engine, comprising a carrier member carrying a plurality of vanes which is angularly movable, in use, so as to vary the position of the vanes relative to an airflow through the engine, an electrical drive arrangement comprising an input shaft which is arranged to drive an output shaft coupled to the carrier member and a brake arrangement arranged to apply a braking load to the input shaft in the event that operation of the electrical drive arrangement is interrupted.

2. The vane actuator according to claim 1, wherein the output shaft has an input drive end which is coupled to the input shaft through a gear arrangement, and an output driven end which is coupled to the carrier member.

3. The vane actuator according to claim 1, wherein the carrier member takes the form of a carrier ring.

4. The vane actuator according to claim 1, wherein the electrical drive arrangement comprises a motor, the input shaft being rotatable under the influence of the motor.

5. The vane actuator according to claim 1, wherein the brake arrangement comprises a plurality of first brake elements which are rotatable with the input shaft and which are engageable with respective ones of a plurality of second brake elements to control the braking load applied to the input shaft.

6. The vane actuator according to claim 1, wherein the brake arrangement further comprises an electromagnetic actuator comprising an armature which is carried by the input shaft and which is movable under the influence of a magnetic field generated by an energisable winding.

7. The vane actuator according to claim 6, wherein the electromagnetic actuator is arranged such that energisation of the winding causes the armature to be attracted towards the winding, thereby causing the first and second brake elements to disengage from one another to remove the braking load from the input shaft, and whereby de-energisation of the winding causes the first and second brake elements to move into engagement with one another under the action of a return spring such that the braking load is applied to the input shaft.

8. The vane actuator according to claim 1, including a ballscrew actuator, said ballscrew actuator comprising an input member which is angularly movable upon rotation of the input shaft, the output shaft being axially movable upon angular movement of the input member.

9. The vane actuator according to claim 8, wherein the output shaft is coupled to a linkage, the linkage being arranged to impart angular movement to the carrier member upon axial movement of the output shaft.

10. The vane actuator according to claim 8, wherein the input member is provided with a screw thread formation including a helical groove, and further comprising spherical elements carried by the output shaft and in rolling engagement in said helical groove to form a ballscrew coupling between the input member and the output shaft.

11. The vane actuator according to claim 8, wherein the input member of the ballscrew actuator is provided with a flange to which the input shaft is coupled through a gear arrangement.

12. The vane actuator according to claims 8, wherein the ballscrew actuator comprises overload protection means for applying a braking force to the input member in the event that an axial overload is applied to the output shaft, thereby to prevent loading of the electrical drive arrangement.

13. The vane actuator according to claim 1, wherein the actuator includes first and second ballscrew actuators having respective output shafts, each of the output shafts being coupled to the carrier member and being coupled together through a common drive and synchronisation shaft to ensure axial movement of the output shafts is substantially synchronised.

14. The vane actuator according to claim 1, wherein the actuator includes at least one rotary actuator for imparting angular movement to the carrier member.

* * * * *